US006629440B1

(12) United States Patent
Meekma et al.

(10) Patent No.: US 6,629,440 B1
(45) Date of Patent: Oct. 7, 2003

(54) ADJUSTABLE CABLE LOCK

(75) Inventors: Glenn P. Meekma, Menomonec Falls, WI (US); John B. Zapushek, Racine, WI (US)

(73) Assignee: Master Lock Company, Milwaukee, WI (US)

( * ) Notice: Subject to any disclaimer, the term of this patent is extended or adjusted under 35 U.S.C. 154(b) by 23 days.

(21) Appl. No.: 09/655,625

(22) Filed: Sep. 5, 2000

(51) Int. Cl.[7] ..... E03B 67/06
(52) U.S. Cl. ..... 70/49; 70/14; 70/16; 70/19
(58) Field of Search ..... 70/14–19, 30, 70/49

(56) References Cited

U.S. PATENT DOCUMENTS

| | | | | | |
|---|---|---|---|---|---|
| 380,961 | A | * | 4/1888 | Waine | 70/19 |
| 507,948 | A | * | 10/1893 | Waine | 70/49 |
| 539,650 | A | * | 5/1895 | Searle | 70/49 |
| 558,814 | A | * | 4/1896 | Hunt | 70/49 |
| 1,161,562 | A | * | 11/1915 | Wesson | 70/16 |
| 1,358,184 | A | | 11/1920 | Voight | 70/259 |
| 1,380,719 | A | | 6/1921 | Johnson | 70/49 |
| 1,384,561 | A | | 7/1921 | Hampton | 70/49 |
| 1,394,259 | A | | 10/1921 | Johnson | 70/259 |
| 1,475,256 | A | | 11/1923 | Belair | 70/18 |
| 1,531,451 | A | * | 3/1925 | Neal | 70/16 |
| 1,539,301 | A | | 5/1925 | Cooper | 70/49 |
| 1,566,965 | A | | 12/1925 | Johnson | 70/18 X |
| 1,660,040 | A | | 2/1928 | Lehtonen | 24/134 KB |
| 1,851,207 | A | * | 3/1932 | Neal | 70/16 |
| 1,855,686 | A | * | 4/1932 | Neal | 70/16 |
| 1,900,242 | A | * | 3/1933 | Latou | 70/16 |
| 2,190,661 | A | | 2/1940 | Hauer | 70/49 |
| 2,390,885 | A | * | 12/1945 | Kelley | 70/16 |
| 2,570,662 | A | * | 10/1951 | Gray | 70/16 |
| 2,759,349 | A | * | 8/1956 | McKee | 70/16 |
| 3,435,642 | A | * | 4/1969 | Del Pesco | 70/49 |
| 3,841,118 | A | | 10/1974 | Stone | 70/33 |
| 3,907,255 | A | | 9/1975 | McElroy | 254/156 |
| 4,287,731 | A | * | 9/1981 | Kruger | 70/16 |
| 4,509,346 | A | * | 4/1985 | Szczepanek | 70/16 |
| 4,574,600 | A | * | 3/1986 | Moffett | 70/16 |
| 4,850,207 | A | * | 7/1989 | Ylven | 70/49 |
| 5,473,917 | A | * | 12/1995 | Say | 70/49 |
| 5,517,835 | A | | 5/1996 | Smith | 70/14 |
| 5,660,064 | A | * | 8/1997 | Ecker et al. | 70/16 |
| 5,743,117 | A | * | 4/1998 | Woo et al. | 70/16 |
| 5,791,170 | A | | 8/1998 | Officer | 70/49 |
| 6,003,348 | A | | 12/1999 | McCrea | 70/18 |
| 6,212,919 | B1 | * | 4/2001 | Gerow | 70/18 |

FOREIGN PATENT DOCUMENTS

| | | |
|---|---|---|
| CA | 1171294 | 7/1984 |
| CA | 2190575 | 11/1995 |
| EP | 0 893 562 A1 | 1/1999 |

* cited by examiner

*Primary Examiner*—Suzanne Dino Barrett
(74) *Attorney, Agent, or Firm*—Calfee, Halter & Griswold LLP

(57) ABSTRACT

The present lock construction, for securing a movable object to a fixed object, includes a housing having an interior cavity and an elongated member having a first portion secured within the housing and a second portion slidably received within the housing. The elongated member is slidable within the passageway to a locked position, securing the movable object to the fixed position and to an unlocked position, releasing the object from the fixed object. First and second members are slidably disposed in the housing and are movable to engage the cable in the locked position. A rotatable locking mechanism is disposed within said housing and is engageable with the first member to permit slidable movement of the first member and thereby allow slidable movement of the elongated member to different locked positions. The rotatable locking mechanism is also engageable with the second member to permit slidable movement of the second member and thereby prevent movement of said elongated member in the locked position.

25 Claims, 8 Drawing Sheets

ADJUSTABLE CABLE LOCK

BACKGROUND OF THE INVENTION

The present invention relates generally to a lock construction and particularly to a cable lock for securing items such as bicycles, skis or other movable objects to a bar, post or some other fixed objects. These items are typically portable and are often used to transport the user to different locations such that it is frequently desirable to secure these items to a fixed object that is easily found nearby. Moreover, these movable and fixed objects are typically constructed in different sizes and configurations that is additionally desirable to secure these items in a manner that is adaptable to the various shapes, sizes and configurations of the movable and fixed objects.

Several devices have been developed to accommodate the securing of various movable objects to fixed objects. U.S. Pat. No. 5,791,170 to Officer discloses a portable locking device having three operating positions, namely an unlocked position, a ratchet position and a locked position. The locking mechanism includes an eccentric positioning cam that is mounted on the positioning cam and is adapted to engage the cable as the cable is fed through the lock. Turning the key in the locking mechanism effects movement of the positioning cam such that the clamping member is engageable with the cable at different locations of the clamping member. The positioning cam is otherwise connected on one side to a spring that is secured in a cutout of the lock housing for urging the positioning cam in a rotative direction. The construction of the Officer portable locking device relies on the rotor spring to retain the lock in various operational positions. Any rotation or movement of the rotor, due to vibration or external tampering, would invariably compromise the integrity of the lock. Additionally, the structure of the Officer lock affords only a point contact between the clamping mechanism and the cable that further comprises the ease of operation afforded by the lock.

U.S. Pat. No. 2,190,661 to Hauer discloses another cable lock having a locking cam with a corrugated cam end that is used to allow the locking cam to depress the cable into a recess in the housing. A cam spring is mounted within the housing to displace the cam against the cable with sufficient force to engage and lock the cable. Although the corrugated cam increases the gripping force on the cable, the Hauer lock construction is similar to the Officer lock construction in that it also relies only on the rotatable locking cam without other structural supports to maintain the various operational positions of the lock. Thus, the level of security and the ease of operation provided by the Hauer lock are similarly less than desirable.

SUMMARY OF THE INVENTION

The present invention is directed to a lock construction for securing a movable object to a fixed object. The lock construction comprises a housing having a passageway extending through the housing. An elongated member has a first portion that is secured within the housing and a second portion that is slidably received within the passageway. The elongated member is slidable within the passageway to a locked position, securing the movable object to the fixed object, and to an unlocked position, releasing the movable object from the fixed object. A first member is disposed in the housing and is movable to engage the elongated member in the locked position. A second member is also slidably disposed within the housing and is operatively associated with the first member to allow slidable movement of the first member. A rotatable locking mechanism is disposed within the housing and is engageable with the first member to permit slidable movement of the first member and thereby allowing slidable movement of the elongated member to different locked positions. The rotatable locking mechanism is also engageable with the second member. In engaging the second member, the locking mechanism permits slidable movement of the second member and thereby preventing movement of said elongated member in the locked position.

DESCRIPTION OF THE PREFERRED EMBODIMENTS

Figure 1:
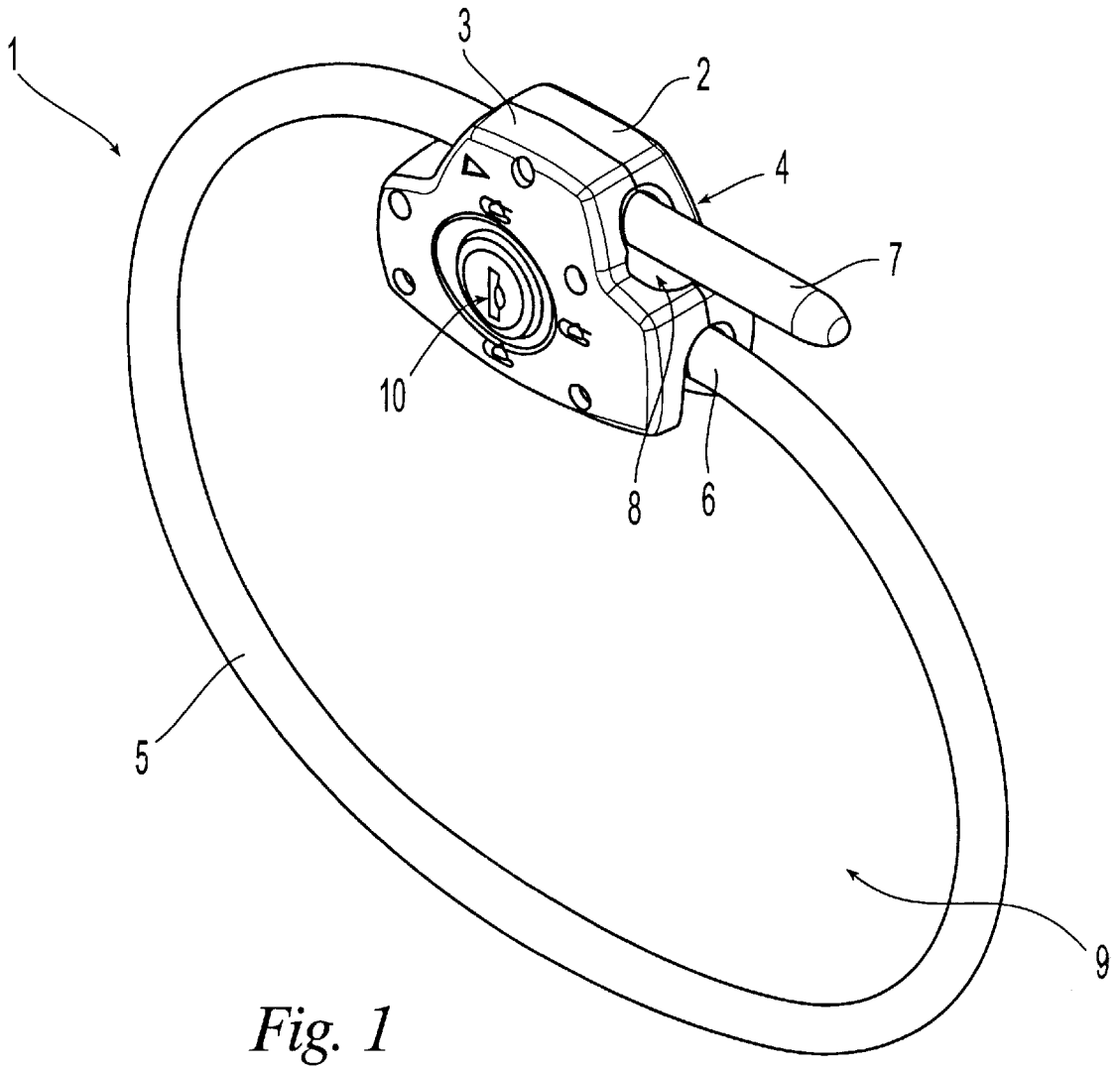
FIG. 1 is a perspective view of a lock constructed according to the present invention.

Referring to FIG. 1, the lock construction 1 of the present invention is shown having two engaging covers 2 and 3 that are mated to each other to form a lock housing 4. The lock construction 1 further includes an elongated member, preferably in a form of a cable 5, with first and second portions 6 and 7 forming the length of the cable 5. The end of the first portion 6 is secured within the housing 4, and the second portion 7 is slidably received in a passageway 8 extending through the lock housing 4. The cable 5 is securable to the lock housing 4, and depending on the extent to which the second portion 7 is inserted within the housing 4, the cable 5 forms a loop 9 of variable sizes. Thus, by threading the cable 5 about a movable object to be secured, such as a bike, and around a fixed object, such as a pole, before inserting the first portion 7 into the housing 4, the cable 5 may be pulled through the passageway 8 such that the loop 9 is dimensioned to tightly secure the bike to the pole.

Figure 2:
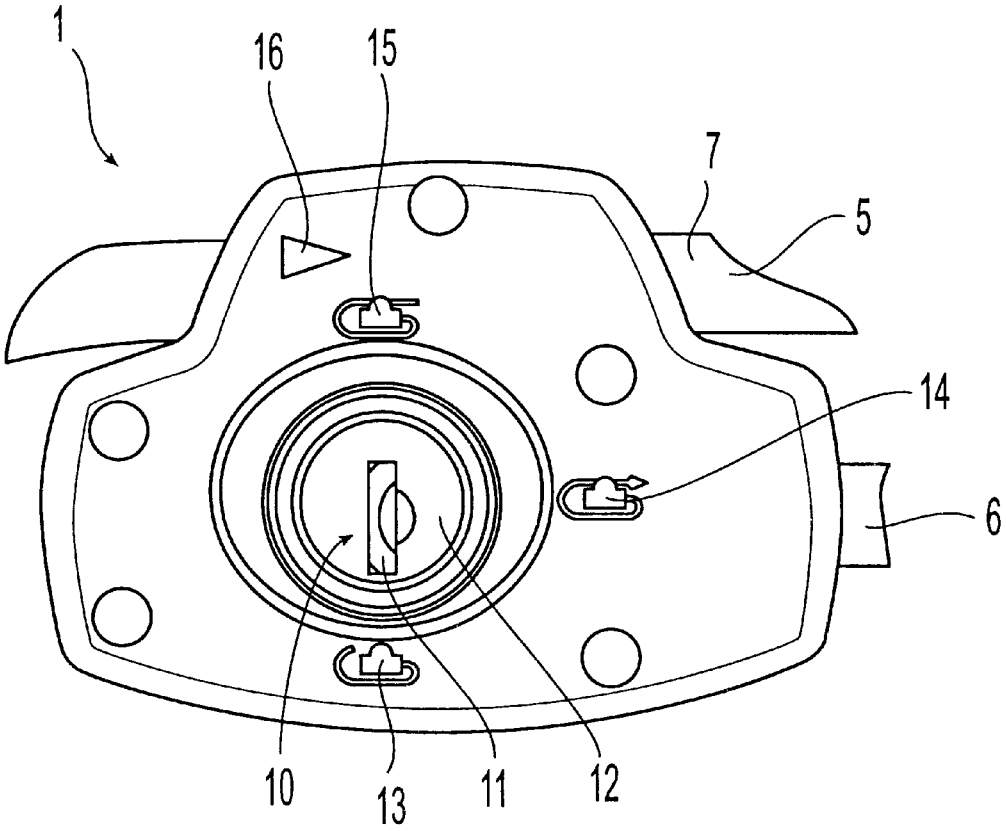
FIG. 2 is a front view of the lock of FIG. 1, partially showing a cable received within a housing.

A keyway 10, better shown in FIG. 2, is located on the front of the lock construction 1 for inserting an authorized key to operate the lock construction 1. Preferably a pivotable keyway cover 11 is disposed over the keyway 10 to protect against dirt or other debris that may enter the lock housing 4 through the keyway 10. The keyway 10 is connected to a rotatable locking mechanism 12 disposed in the interior cavity of the housing 4. The locking mechanism 12 includes a lock cylinder, not shown in FIG. 2, which is preferably a conventional tumbler lock assembly having a plurality of tumbler pins that are fitted for the authorized key. Other locking mechanisms, such as wafer tumblers or electronic access devices with key-pad entry may also be used.

The lock construction 1 has various operational positions in which the cable 5 can be manipulated to form substantially any size loop 9 with the lock housing 4. The lock construction 1 has an unlocked position in which the cable 5 is slidably receivable in the passageway 8 and is movable in a first direction, the direction of insertion, to form smaller loops 9 with the housing 4. In the unlocked position, the cable is also slidably removable in a second direction, opposite the direction of insertion, to form larger loops 9 with the housing 4 and eventually to be removed from the housing 4 for releasing the objects secured.

The lock construction 1 has a first locked position, or a cinch position, in which the cable 5 is also slidably receivable in the passageway 8 in the first direction. The cinch position differs from the unlocked position, however, in that the cable 5 cannot be released in the second direction. The cable 5 is prevented from movement in the second direction through the housing 4 and is only allowed to move in the first direction to allow the user great ease in tightening or cinching the cable 5 around the object and the fixture.

The lock construction 1 further includes a second locked position, or the dead locked position, in which the cable 5 is prevented from any movement in the first or second directions through the passageway 8. The user selects these operational positions by inserting the authorized key into the keyway 10 and rotating the key to the desired operational position, the details of which will be discussed in greater depth hereinafter.

Markers are preferably disposed on the front of the lock construction 1 for visually assisting the user in locating these operation positions. Marker 13 marks the key position for locating the lock 1 in the unlocked position. Marker 14 marks the key position for locating the lock 1 in the cinch position. Finally, Marker 15 marks the key position for locating the lock 1 in the dead locked position. Additional markers, such as an arrow 16, may also be used to show the direction of insertion of the cable 5. With the various operational positions so marked, the operation of the lock construction 1 is greatly simplified since the user needs only to insert and rotate the authorized key to the marked location for performing the desired operation of the lock construction 1.

Figure 3:
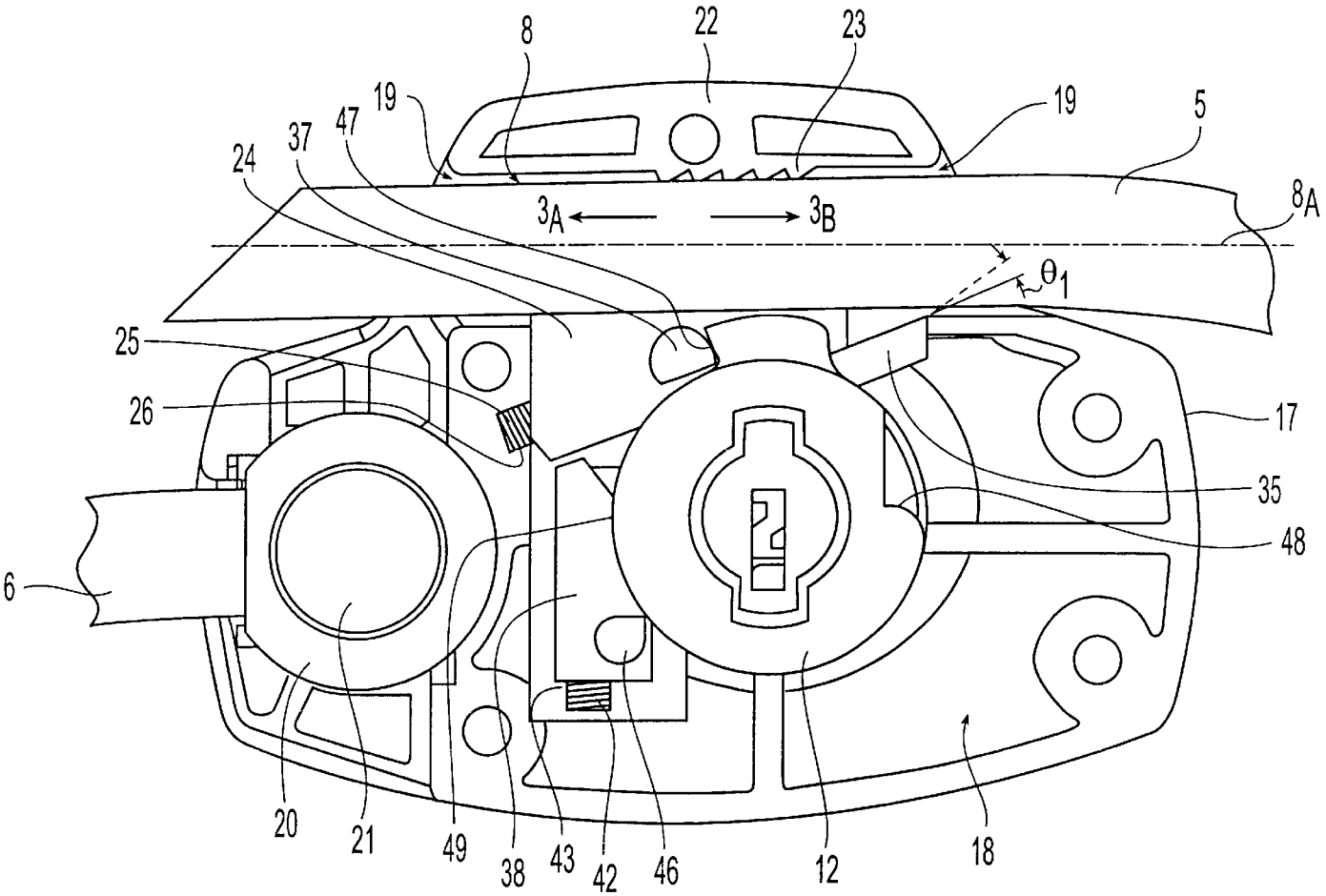
FIG. 3 is a front view of the lock of FIG. 1 with a cover removed, showing the operational elements therein in an unlocked position.

Referring now to FIG. 3, the cover 2 of the housing 4 forms an exterior surface 17 and defines one-half of an interior cavity 18. The portion of the passageway 8 formed by the cover 2 is shown extending from one side of the exterior surface 17 to the other through the interior cavity 18. An opening 19 is formed by the passageway 8 on the exterior surface 17 to slidably receive the cable 5 through the passageway 8. The other end of the cable 5, namely the end of portion 6, is preferably received and secured in a cap 20 that is anchored by a pin 21 in interior cavity 18. The pin 21 securely anchors the end of portion 6 within the interior cavity 18 while allowing the first portion 6 of the cable 5 pivotable movement about the pin 21. The pivotable movement of the first portion 6 allows greater ease in manipulating the cable 5 during operation of the lock construction 1. The second end 7 of the cable 5 is insertable into and through the passageway in the first direction, as shown by arrow $\mathbf{3}_A$, for tightening the loop 9 of the cable 5 through the passageway 8. The second portion 7 of the cable 5 is also slidable in the second direction, as shown by arrow $\mathbf{3}_B$, for loosening the loop 9 in releasing the cable 5 from the housing 4.

An extension 22 extends from each of the covers 2 and 3 of the housing 4, only one of which is shown in FIG. 3, to form the top portion of the passageway 8. Preferably the extensions 22 include a toothed interior surface having toothed protrusions 23 to assist with grasping and retaining the cable 5 as it is inserted through the passageway 8. Most preferably, each of the protrusions 23 is arranged in an asymmetrical fashion, with one side of the toothed protrusion longer than the other with the protrusion pointing in the axially inward and generally in the direction of insertion $\mathbf{3}_A$.

The asymmetric protrusions 23 are oriented to increase the level of security provided by the lock 1. For example, toothed protrusions that extend perpendicularly from the interior surface of the passageway 8 assist with grasping the cable 5, as stated earlier, by having the protrusions 23 physically engage or dig into portions of the cable 5. Exerting substantial force by pulling on the cable 5 with the protrusions 23 in engagement with the cable 5 can form grooves on the cable 5 and thereby compromising the level of security provided by the lock 1 by preventing the formation of grooves on the cable 5, even when the cable 5 is being tampered with.

Figure 4:
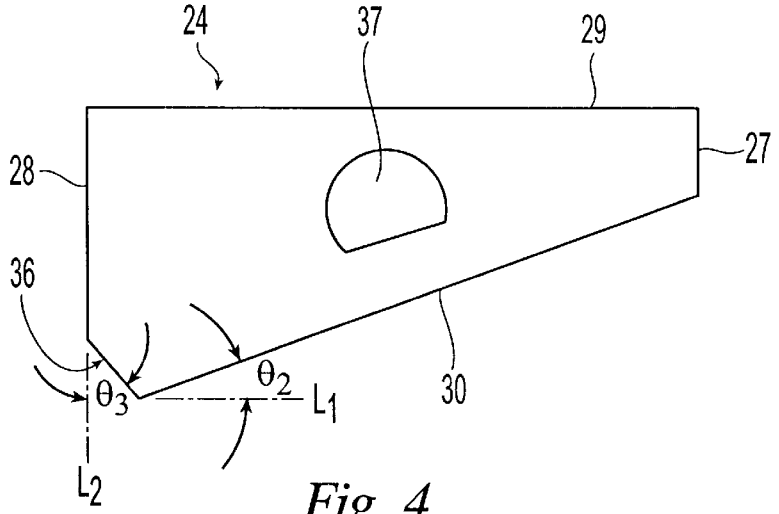
FIG. 4 is a front view of a first member of the lock of FIG. 1.
Figure 5:
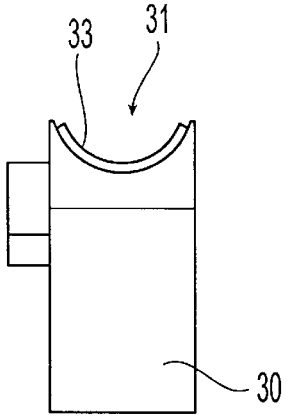
FIG. 5 is a side view of the first member of FIG. 4, showing a recess for receiving a cable.

Forming the base portion of the passageway 8 is a first member 24 that is slidably disposed in the interior cavity 18 to engage the cable 5. The first member 24 is resiliently biased toward the cable 5 by a first spring 25 that is disposed in a recess 26 in the housing 4. As shown in FIGS. 4 and 5, the first member 24 has preferably parallel front and back sides 27 and 28, a top side 29 and a bottom side 30. The top side 29 defines a recess 31 extending across the entire top side 29 for engaging the cable 5, as better shown in FIG. 5. Thus, the recess 31 forms the bottom portion of the passageway 8. As the first member 24 is biased by the spring 25 in a slidable fashion, the diameter of the passageway 8 is variable according to the slidable movement of the first member 24 when biased by the spring 25. As with the protrusions 23 disposed on the extension 22, toothed protrusions 33 are also preferably disposed on the interior surface of the recess 31 to assist with grasping and engaging the cable 5. The protrusions 23 and 33, respectively shown in FIGS. 3 and 5, are configured as parallel ridges extending circumferentially across a portion of the passageway 8. Other protrusion configurations, having a individual saw tooth configuration or staggered points may also be used in the passageway 8 to assist with grasping and engaging the cable 5.

The bottom side 30 of the first member is sloped from the front side 27 downwardly toward the back side 28, as shown in FIG. 4. Referring back to FIG. 3, the sloped side 30, is in an abutting contact with an incline 35 disposed in the housing 4 when the lock 1 is assembled. The incline 35 is preferably integrally constructed with the housing 4 to guide the slidable movement of the first member 24 when biased by the spring 25. The passageway 8 further includes a longitudinal axis $\mathbf{8}_A$, as shown in FIG. 3, with which incline 35 forms a first angle $\Theta_1$. Similarly, the sloped bottom side 30 of the first member 24 forms an angle $\Theta_2$ with a line $L_1$ that is parallel to the axis $\mathbf{8}_A$, as shown in FIG. 4. Preferably, angle $\Theta_1$ of the incline 35 is equal to angle $\Theta_2$ of the bottom side 30 such that the passageway 8 has a substantially uniform diameter extending through the interior cavity 18.

As stated previously, the first member 24 is slidable toward the cable 5 along the incline 35 by the force of the first spring 25. Preferably, the first spring 25 is oriented such that the resultant force of the spring 25 is in a direction substantially parallel to the incline 35. Thus, the first member 24 is slidable along the incline 35 with the sloped bottom surface 34 in abutting contact therewith, further maintaining a substantially uniform diameter through the passageway 8.

The first member 24 further includes a cutout 36 extending between the bottom side 30 and the back side 28. The cutout 36 defines an angle $\Theta_3$ with a line $L_2$ that is perpendicular to axis $8_A$, as shown in FIG. 4. Additionally, a first knob 37 extends from the first member 24. The details of the interface between the cutout 36 and the knob 37 will be discussed in greater details hereinafter.

Figure 6:
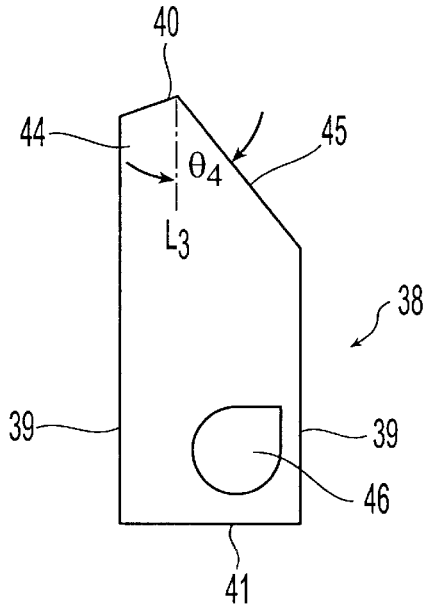
FIG. 6 is a front view of a second member for the lock.

Referring back to FIG. 3, a second member 38 is also disposed in the housing 4 for slidable movement therein. The second member 38 preferably has substantially parallel sides 39, a top side 40 and a bottom side 41, best shown in FIG. 6. Similar to the sides 27–30 of the first member 24, the sides 39–41 of the second member 38 may be formed having perpendicular edges or rounded edges. Like the first member 24, the second member 38 is also resiliently biased in the interior cavity 18 by a second spring 42 that is disposed in a recess 43 of the housing 4. The second spring 42 biases the second member 38 upwardly toward the first member 24. The opt side 40 of the second member 38 forms a wedge 44 that has a sloped surface 45. The sloped surface 45 defines an angle $\Theta_4$ with a line $L_3$ perpendicular to the longitudinal axis $8_a$, as shown in FIG. 6. Preferably, $\Theta_3$ of the cutout 36 and $\Theta_4$ of the wedge 44 are selected to correspond to each other such that upward movement of the second member 38 toward the first member 24 causes the wedge 44 to engage the cutout 36 of the first member 24 in an abutting contact. A second knob 46 is disposed on the second member 38, the function of which will be discussed hereinafter.

Referring back again to FIG. 3, the rotatable locking mechanism 12 discussed previously has first and second tabs 47 and 48 extending from the locking mechanism 12 and are rotatable therewith to respectively engage the first and second member 24 and 38. As shown in FIG. 3, the lock 1 is in the unlocked position with the first tab 47 engaging the first knob 37 against the biasing force of the spring 25 to prevent displacement of the first member 24 by the first spring 25. The passageway 8 is therefore clear for insertion of the cable 5. As stated above, the top side 29 of the first member 24 and the bottom side of the extension 22 respectively form the top and bottom sides of the passageway 8. Thus, the first tab 47 preferably engages the first knob 37 such that the passageway 8 has a diameter extending therethrough that is sufficiently larger than the diameter of the cable 5 to ensure greater ease in the insertion of the cable.

Additionally a periphery portion 49, shown as having an arcuate shape, extends on the periphery of the locking mechanism 12 between the first and second tabs 47 and 48. The arcuate portion 49 engages the second knob 46 to displace and hold the second member 38 against the biasing force of the second spring 42, preventing upward movement of the second member 38. Accordingly, the second member 38 is prevented from engaging the cutout 36 of the first member 24. Thus, the orientation and disposition of the locking mechanism 12, with the first member 24 prevented from moving along the incline 35 to engage the cable 5 and the second member 38 prevented from engaging the first member 24, renders the lock construction 1 in the unlocked position. Accordingly, the cable 5 is free to slide in either the first or the second direction shown by the arrow $3_A$ and $3_B$ to tighten or loosen the loop 9.

Figure 7:
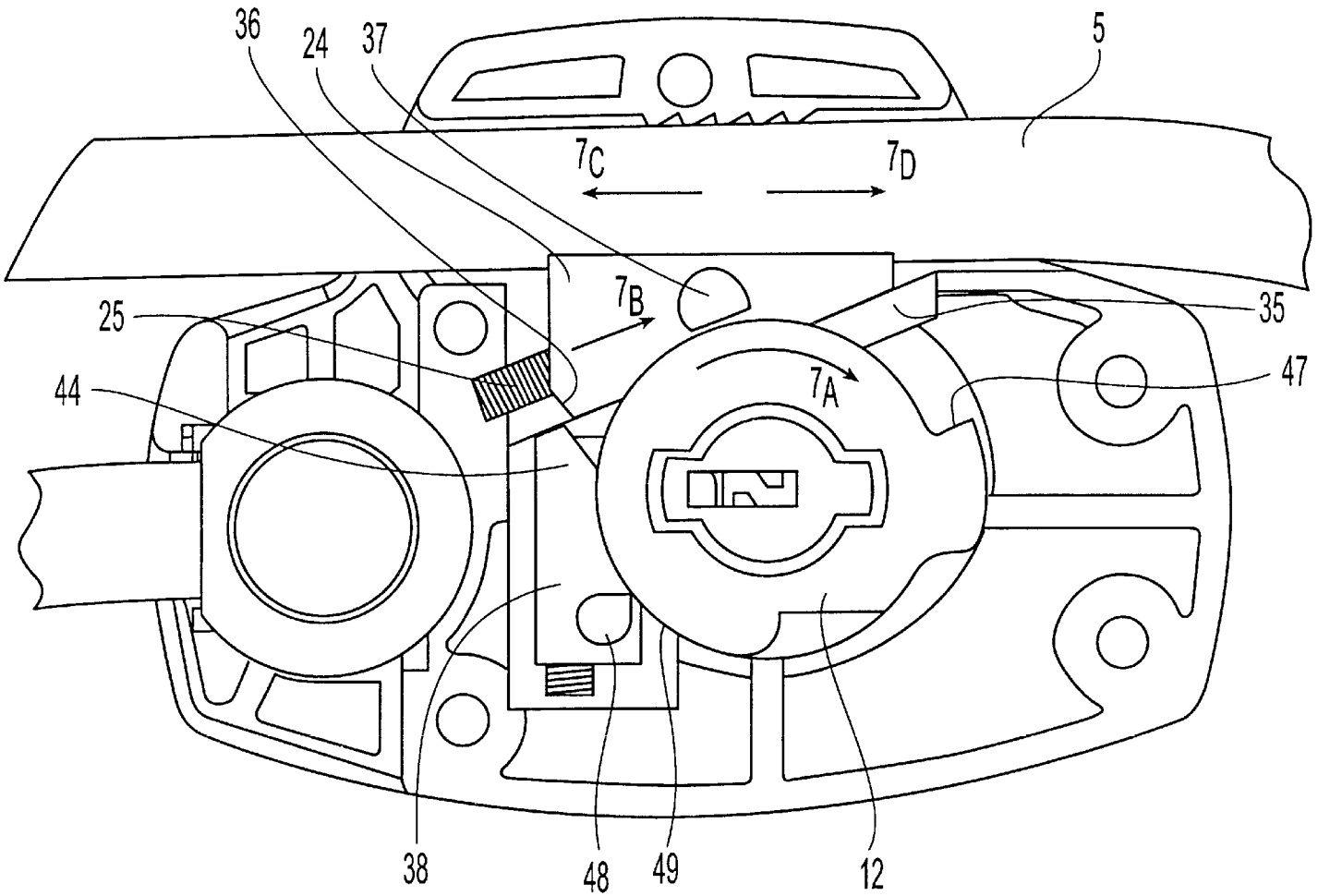
FIG. 7 is a front view of the lock of FIG. 1 in a cinch position.

As the locking mechanism 12 is rotated about 90° in a clockwise rotation, as shown by the arrow $7_A$ in FIG. 7, to the cinch position as marked by marker 14 in FIG. 2, the first tab 47 is moved out of engagement with the first knob 37 and the first member 24 therefore slides along the incline 35 biased by the first spring 25 to engage the cable 5 and to contract the passageway 8. Preferably, the instant the first tab 47 of the locking mechanism 12 is rotated out of engagement with the first knob 37, the force of the first spring 25 begins biasing the first member 24 in the direction shown as arrow $7_B$ against the cable 5. The force of the first spring 25 slides the first member 24 along the incline 35 until the first member 24 is wedged securely between the cable 5 and the incline 35. The wedged position of the first member 24 prevents the cable 5 from being pulled in the second direction $7_D$. Any force pulling on the cable 5 in the second direction $7_D$ causes the first member 24 to be "wedged" tighter between the cable 5 and the incline 35, thereby more securely locking the cable 5.

Moreover, while the lock 1 is in the cinch position with the locking mechanism 12 rotated 90° from the unlocked position, the arcuate portion 49 of the locking mechanism 12 retains engagement with the second tab 48 of the second member 38. Thus, the wedge 44 of the second member 38 is prevented from contacting the first cutout 36 and the first member 24 is allowed to move against the force of the spring 25 when sufficient pulling force is exerted on the cable 5 in the first direction, as shown by arrow $7_C$. As the cable 5 is prevented from slidable movement in the second direction, $7_D$, the loop 9 can be pulled through the housing 4 to form smaller loops 9 or to tighten around the object and the fixture.

Figure 8:
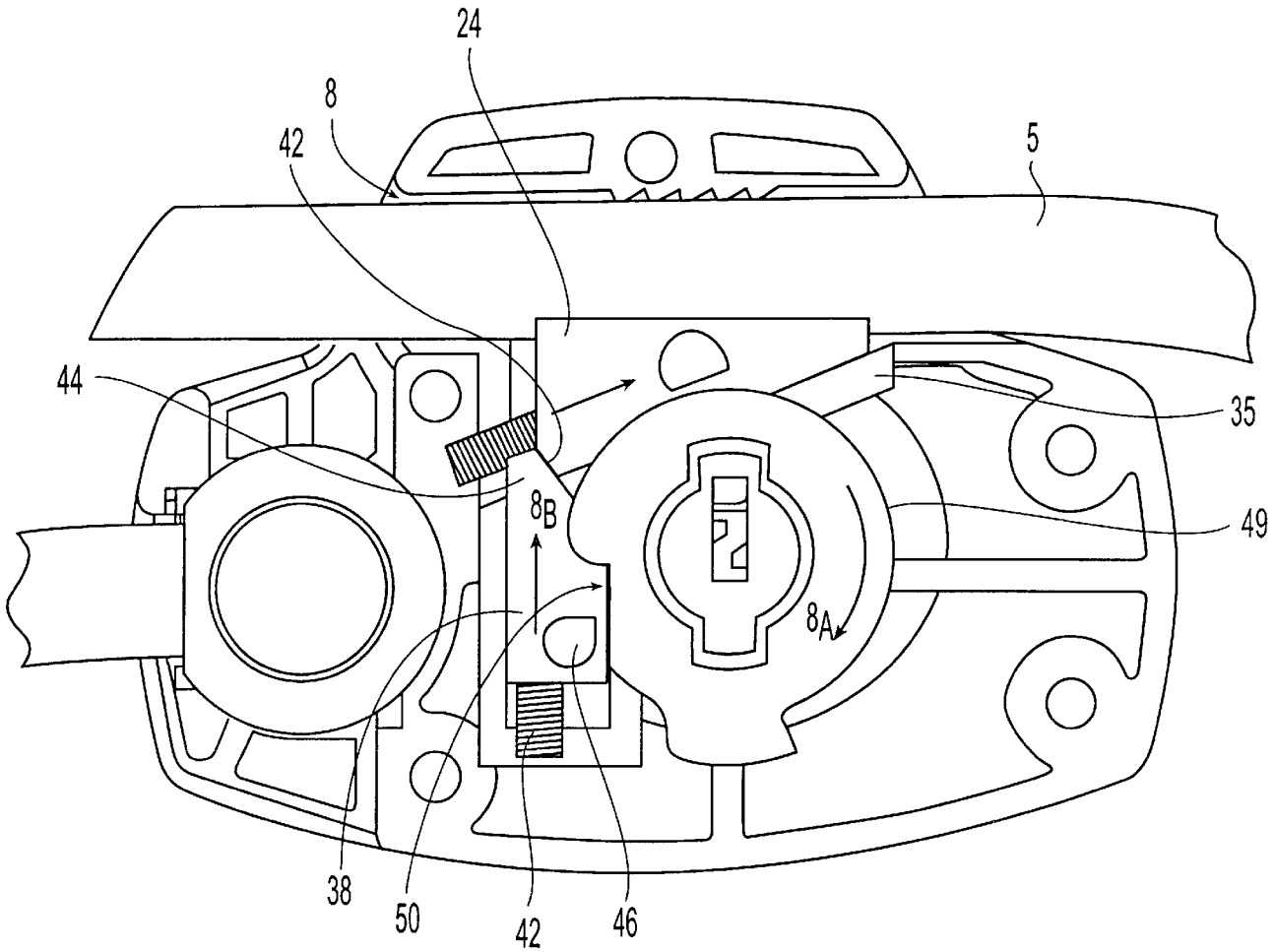
FIG. 8 is a front view of the lock of FIG. 1 in a dead locked position.

When the cable 5 is sufficiently tightened about the object and the fixture, the locking mechanism 12 may be rotated yet another 90° in the clockwise direction, as shown by arrow $8_A$ in FIG. 8, to the dead position, shown as marker 15 in FIG. 2. Referring back to FIG. 8, the rotation of the locking mechanism 12 from the cinch position rotates the arcuate portion 49 out of engagement with the knob 46. Accordingly, the second member is allowed to move upwardly by the biasing force of the second spring 42 such that eventually the wedge 44 of the second member 38 is in abutting contact with the cutout 36 or the first member 24. Once the wedge 44 is in abutting contact with the cutout 36, the first member 24 is prevented from slidable movement along the incline 35 in either direction, and the cable 5 is thereby prevented from being tightened or released from the housing 4. The abutting contact between first and second member 24 and 38 securely locks the cable 5 in the passageway 8 by positively filling the void spaces between the locking mechanisms 12 and the cable 5. Accordingly, the cable 5 is secured against any inadvertent rotation of the locking mechanism 12 due to vibration when the lock 1 is exposed to impact from an external force. Moreover, inadvertent rotation of the locking mechanism 12 is also prevented when minor movement of the first or second members 24 and 38 is caused by tampering with cable 5.

Figure 9:
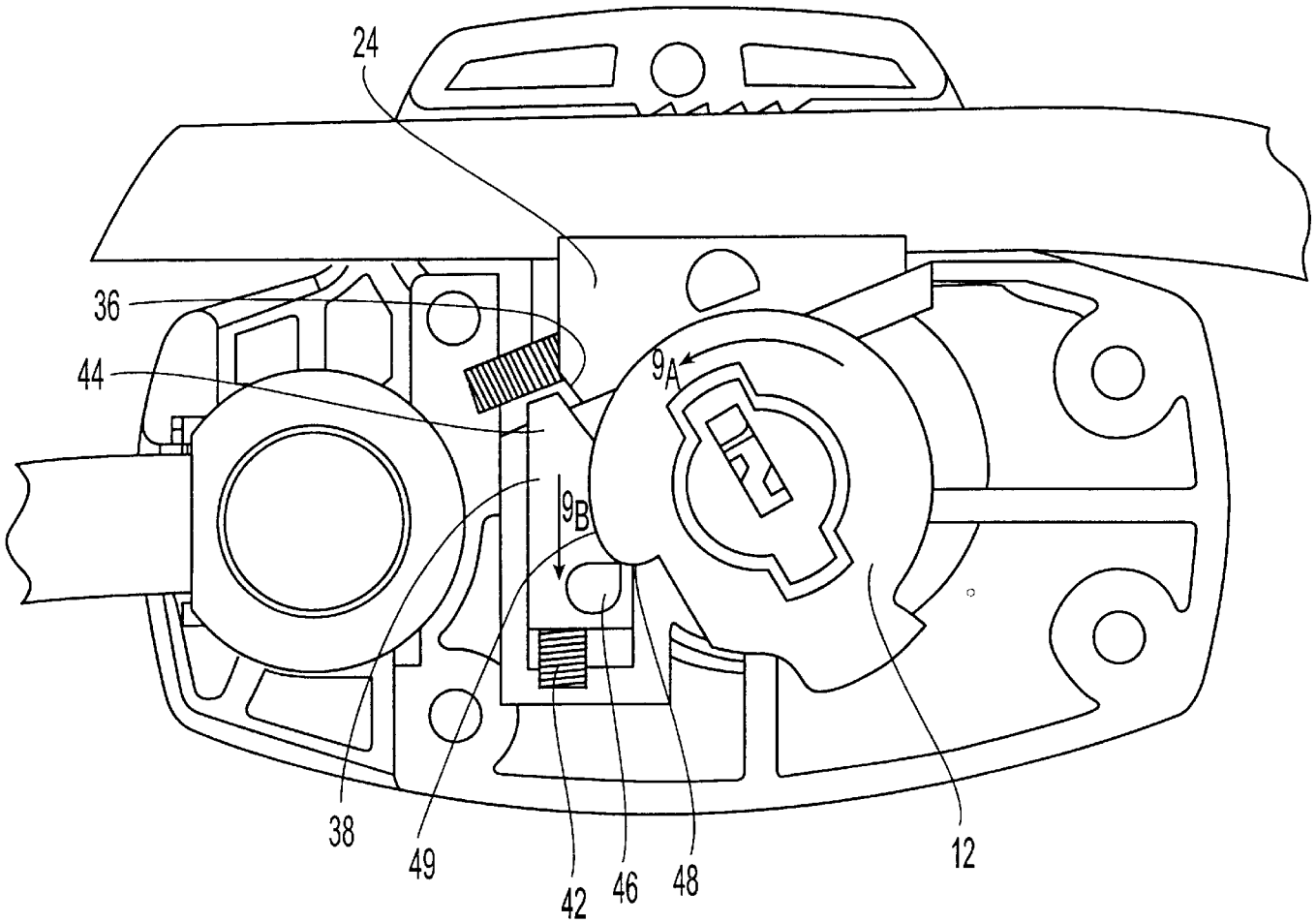
FIG. 9 is a front view of the lock of FIG. 1 between the cinch position and the locked position.

Rotating the locking mechanism 12 in a counterclockwise direction thereafter, as shown by the arrow $9_A$ in FIG. 9, engages the second tab 48 with the second knob 46, displacing the second member 38 in a downward direction shown by arrow $9_B$ against the biasing force of the spring 42. Further rotation in the counterclockwise direction of the locking mechanism 12, further displaces the second member 38 until the arcuate portion 49 is again in engagement with the second knob 46. Accordingly, the second member 38 is reverted back away from the first member 24, and the lock construction 1 is again in the cinch position, allowing movement of the cable 5 in the first direction only, as discussed previously.

Figure 10:
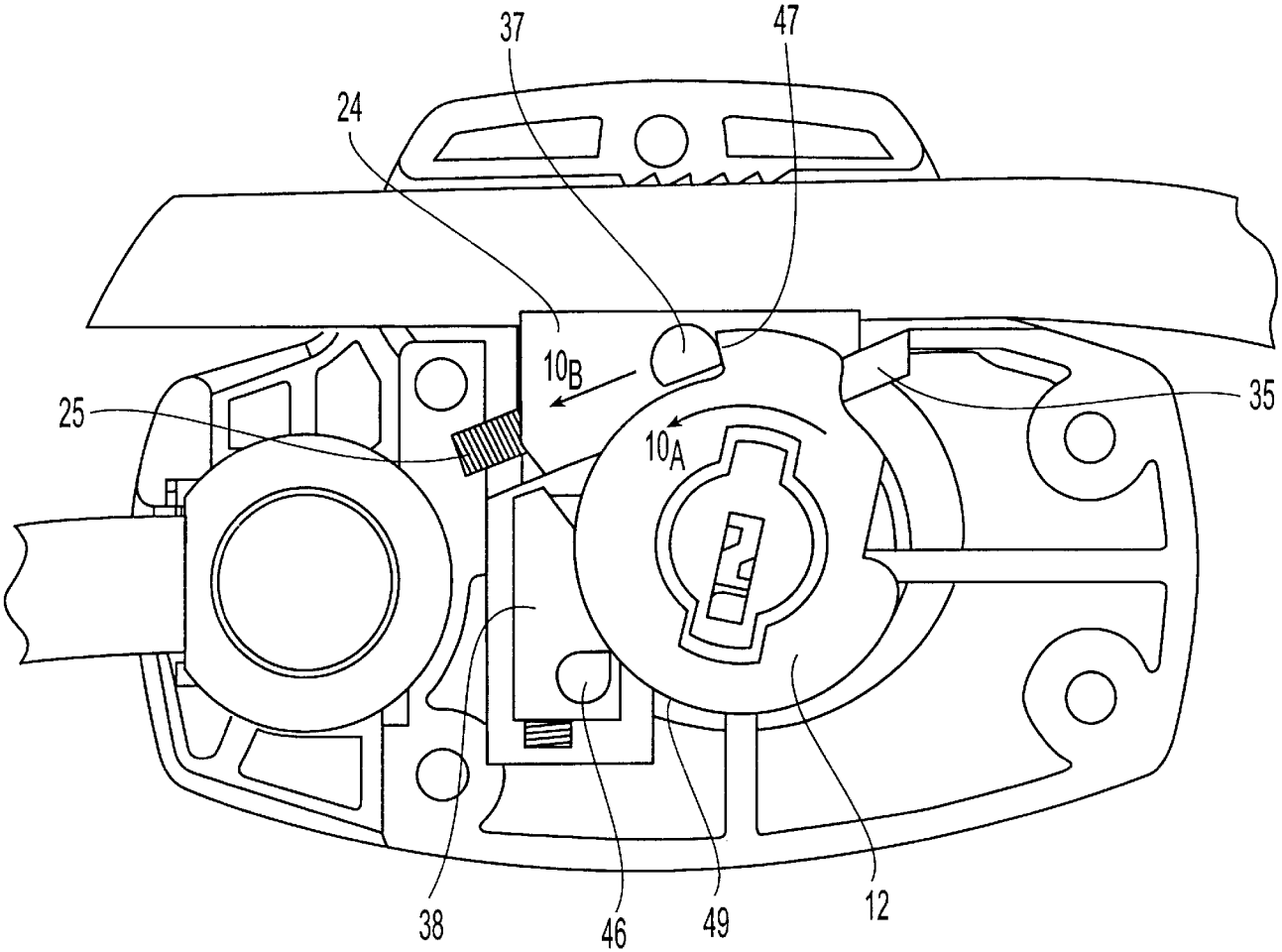
FIG. 10 is a front view of the lock of FIG. 1 between the cinch position and the unlocked position.

Further counterclockwise rotation of the locking mechanism 12, as shown by arrow $10_A$ of FIG. 10, reengages the first tab 47 with the first knob 37. The first tab 47 engages the first knob 37 against the biasing force of the first spring 25, as shown by arrow $10_B$, displacing the first member 24 away from the cable 25, and positions the lock construction 1 in the unlocked position. As the arcuate portion 49 of the locking mechanism 12 is still engaged with the second knob 46, the second member 38 is out of engagement with the first member 24. Thus, the cable 5 is slidable from the lock housing 4 in both the first and second directions, allowing removal therefrom.

The angles $\Theta_1$ and $\Theta_2$ of the incline 35 and the bottom side 30 of the first member 24 will generally determine the travel distance required by the first member 24 to engage the cable 5. Accordingly, depending on the desired overall configurations and dimensions of the lock housing 4, angles $\Theta_1$ and $\Theta_2$ may be selected to accommodate any desired size of the housing 4. Preferably, the angle $\Theta_1$ and $\Theta_2$ are between about 12° to 25°. Most preferably, angles $\Theta_1$ and $\Theta_2$ are between about 22°–25°. However, other angles may be used with consideration to the compression force of the first spring 25 and the compact size of the housing 4 to ensure proper operation of the lock construction 1.

Similarly, angles $\Theta_3$ and $\Theta_4$ determine the vertical travel distance of the second member 38 before the wedge 44 of the second member 38 engages in abutting contact with the first member 24. Angles $\Theta_3$ and $\Theta_4$ are selected to ensure proper engagement between the first and second members 24 and 38. Preferably angles $\Theta_3$ and $\Theta_4$ are between 45° to 55°. Most preferably, angles $\Theta_3$ and $\Theta_4$ are about 50°.

All the angles and dimensions of the operational elements as described above can be modified accordingly to achieve the desired overall dimension of the lock housing 4 and proper operation thereof. Modification in one of these elements may result in a cascading effect on the dimensions of the remaining elements. For instance, if $\Theta_1$ is increased and the slope of the incline 35 is correspondingly increased, the vertical and horizontal travel of the first member 24 to engage the cable 5 is decreased. Decreasing the vertical travel of the first member 24 accordingly decreases the vertical travel required by the second member 38 to ensure proper contact between the wedge 44 and the cutout 36. The overall dimension of the lock housing 4 can therefore be minimized. On the other hand, sufficient movement of the first and second members 24 and 38 is desirable to ensure that the security level of the lock cannot be easily compromised due to vibration and tempering caused by external sources. Moreover, a significant increase in $\Theta_1$ and the slope of the incline 35 will increase resistance against sliding the cable 5 in the first direction when the lock is in the cinch position. Additionally, the compression force of the first and second springs 25 and 42 also impacts the ease of operation of the lock and therefore the level of security thereby provided.

An illustrative operation of the lock construction 1 will now be described with respect to the preferred embodiment. To secure an object such as a bicycle to a fixture such as a pole, the user takes the lock 1 in the unlocked positions, marked as Marker 13 in FIG. 2, and threads or loops the second end 7 of the cable 5 through portions of the bicycle and wrap the cable 5 around the pole before inserting the second end 7 through the opening 19 into the passageway 8. Since the first tab 47 is in contact with the first knob 37, the passageway 8 is maintained sufficiently cleared to allow ease in inserting the cable 5. Once inserted, the cable 5 is freely slidable in and out of the lock housing 4.

With the second end 7 of the cable 5 sufficiently pulled through the lock housing 4, the user may turn the authorized key within the keyway 10 and rotate the lock mechanism 12 to the cinch position, marked as Marker 14, in FIG. 2. The first member 24 is therefore biased toward the cable 5 by the biasing force of the spring 25 to engage the inserted portion of the cable 5. Thereafter, the user is able to pull the cable 5 through the passageway 8 in the first direction against the force of the spring 24 until the cable 5 forms a tight loop 9 around the bike and the pole the construction of first member. The spring 25 wedges the first member 24 against the cable 5 and in the incline 35 such that the cable 5 is prevented from slipping.

Once the cable 5 is sufficiently tightened about the bike and the pole, the user may rotate the key to the dead locked position, marked as Marker 15 in FIG. 2. The second member 38 is thereby allow to engage the first member 24, preventing the first member 24 from movement against the incline 35 away from the cable 5. Accordingly, the cable 5 is prevented from movement in either the first or second directions, and the bike is securely locked to the pole.

It will be appreciated that those skilled in the art may devise numerous modifications and embodiments within the scope of the present invention. It is intended that the following claims cover all such modifications and embodiments.

We claim:

1. A lock construction, comprising:

a) a housing having an exterior surface and defining an interior cavity;

b) an elongated flexible member having a first portion secured to said housing and a second portion slidably receivable within said interior cavity to form a loop and capture an object with said housing and for movement between at least one locked position within said housing to an unlocked position for releasing said object from said loop;

c) a first member movably disposed in said interior cavity of said housing to slidably engage said elongated member in said locked position to prevent movement of said elongated member within said interior cavity in a first direction;

d) a second member movably disposed in said interior cavity and operatively associated with said first member, prohibiting movement of said first member; and e) a locking mechanism disposed within said housing and disengageable with said first member to permit movement of said first member and thereby allow movement of said elongated member in said first direction, but not in the direction opposite from said from first direction, and disengageable with said second member to allow said second member to prevent movement of said elongated member from said locked position.

2. The lock construction of claim 1, wherein said locking mechanism is rotatable to engage said first and second members.

3. The lock construction of claim 1, wherein said rotatable locking mechanism comprises a first protrusion extending from said locking mechanism and rotatable therewith to engage and urge said first member away from said elongated member to said unlocked position and thereby allowing movement of said elongated member.

4. The lock construction of claim 1, further comprising:

a) a cutout disposed on said first member;

b) a wedge disposed on said second member configured and positioned to engage said cutout of said first member;

wherein engagement between said cutout with said wedge prevents movement of said first member and thereby prevents movement of said elongated member in said locked position.

5. The lock construction of claim 1, wherein said first member is resiliently biased toward said elongated member for engagement therewith.

6. The lock construction of claim 1, further comprising an incline disposed in said housing, said first member being movable toward said elongated member along said incline.

7. The lock construction of claim 6, further comprising a spring disposed in said housing for resiliently biasing said first member along said incline.

8. The lock construction of claim 1, wherein said first member comprises a recess to form a first portion of a passageway with said housing, said passageway extending through said interior cavity of said housing for receiving said elongated member.

9. The lock construction of claim 8, wherein said first member is moveable toward said elongated member to form different sizes of said passageway.

10. The lock construction of claim 8, wherein said first member recess comprises a toothed interior surface for engaging said elongated member.

11. The lock construction of claim 8, wherein at least a portion of said passageway has a toothed interior surface for engaging said elongated member.

12. The lock construction of claim 11, wherein at least one tooth of said toothed interior surface is asymmetrical.

13. The lock construction of claim 8, wherein said housing further comprises an extension to form a second portion of said passageway for receiving said elongated member.

14. The lock construction of claim 1, wherein said second member is resiliently biased toward said first member for engagement therewith.

15. The lock construction of claim 14, further comprising a spring disposed in said housing for resiliently biasing said second member toward said first member.

16. The lock construction of claim 1, wherein said first portion of said elongated member comprises a first end pivotably secured to said housing.

17. The lock construction of claim 1, wherein said elongated member is a cable.

18. The lock construction of claim 1, wherein said second member cammingly engages said first member to prohibit said first member from moving within the interior cavity of said housing.

19. The lock construction of claim 1, wherein the first member is spring biased to engage said elongated member.

20. A lock construction, comprising:

a) a housing having an exterior surface and defining an interior cavity;

b) an elongated member having a first portion secured to said housing and a second portion slidably receivable within said interior cavity to form a loop and capture an object with said housing and for movement between at least one locked position within said housing to an unlocked position for releasing said object from said loop;

c) a first member movably disposed in said interior cavity of said housing to slidably engage said elongated member in said locked position to prevent movement of said elongated member within said interior cavity in a first direction;

d) a second member movably disposed in said interior cavity and operatively associated with said first member, prohibiting movement of said first member; and e) a locking mechanism disposed within said housing and disengageable with said first member to permit movement of said first member and thereby allow movement of said elongated member in said first direction, but not in the direction opposite from said from first direction, and disengageable with said second member to allow said second member to prevent movement of said elongated member from said locked position;

wherein said locking mechanism comprises a first protrusion extending from said locking mechanism and rotatable therewith to engage and urge said first member away from said elongated member to said unlocked position and thereby allowing movement of said elongated member, and a second protrusion extending from said locking mechanism and rotatable therewith to engage and urge said second member away from said first member and thereby allowing movement of said elongated member to different locked positions when said first protrusion of said locking mechanism is out of engagement with said first member.

21. The lock construction of claim 20, wherein said rotatable locking mechanism comprises a periphery portion extending between said first and second protrusions, and said periphery portion engages said first and second members to allow said elongated member to move to different ones of said locked position.

22. The lock construction of claim 21, wherein said rotatable locking mechanism comprises a platform extending between said first and second protrusions and opposite to said periphery portion, and said platform operatively associates with said second member to allow movement of said second member into engagement with said first member and thereby preventing movement of said elongated member in said locked position.

23. A lock construction, comprising:

a) a housing having an exterior surface and defining an interior cavity;

b) a passageway disposed in said housing, extending from said interior cavity to an opening disposed on said exterior surface;

c) an elongated flexible member having a first portion secured to said housing and a second portion slidably receivable within said housing in a first direction to form a loop and capture an object and in a second direction for releasing said object from said loop;

d) a first member slidably disposed in said interior cavity of said housing forming a portion of said passageway and slideable within said interior cavity to form different sizes of said portion of said passageway to lockingly engage said elongated member to prevent movement of said elongated member in said second direction;

e) a second member disposed in said interior cavity of said housing and movable to engage said first member and thereby prevent movement of said elongated member in said first and second directions; and f) a locking mechanism disposed within said housing and disengageable with said first member to permit movement of said first member to form different sizes of said portion of said passageway and disengageable with said second member to allow said second member to prevent said first member from forming different sizes of said portion of said passageway.

24. A lock construction, comprising:

a) a housing having an exterior surface and defining an interior cavity;

b) a cable having a first portion secured to said housing and a second portion slidably receivable within said interior cavity to form a loop and capture an object with said housing and for movement between at least one locked position within said housing to an unlocked position for releasing said object from said loop;

c) a first member movably disposed in said interior cavity of said housing to slidably engage said cable in said locked position to prevent movement of said cable within said interior cavity in a first direction;

d) a second member movably disposed in said interior cavity and operatively associated with said first member, prohibiting movement of said first member; and e) a locking mechanism disposed within said housing and disengageable with said first member to permit movement of said first member and thereby allow movement of said cable in said first direction, but not in said second direction, and disengageable with said second member to allow said second member to prevent movement of said cable.

25. A lock construction comprising:

a) a housing having an exterior surface and defining an interior cavity;

b) a cable having a first portion secured to said housing and a second portion slidably receivable within said interior cavity of the lock construction housing;

c) a first member movably disposed in said interior cavity of said housing to slidably engage said cable;

d) a second member movably disposed in said interior cavity and operatively associated with said first member;

e) a locking mechanism disposed within said housing and disengageable with said first member and said second member;

wherein said locking mechanism has at least three different positions: an unlocked position wherein the locking mechanism engages both said first member and said second member and said cable is free to move in the interior cavity in either direction; a cinched position wherein the locking mechanism disengages said first member allowing said first member to move to a first locked position wherein said cable can move in the direction towards the interior cavity of said housing, but not outward from the interior cavity of said housing; and a locked position wherein said locking mechanism disengages said second member allowing said second member to move into camming engagement with said first member, thereby securing said first member in a second locked position wherein said cable can not move inward toward or outward from the interior cavity of said housing.

* * * * *